US005803094A

United States Patent [19]

Becker et al.

[11] Patent Number: 5,803,094

[45] Date of Patent: Sep. 8, 1998

[54] ARTIFICIAL FINGERNAIL ATTACHMENT AID AND METHOD

[76] Inventors: Jeffrey Bruce Becker, Unit 1094 4771 Summit Ridge Dr., Reno, Nev. 89503; Gregory Pearson Becker, #2, 1032 Tomahawk Trail, Incline Village, Nev. 89451

[21] Appl. No.: 928,276

[22] Filed: Sep. 12, 1997

[51] Int. Cl.[6] ..... A45D 29/00

[52] U.S. Cl. ..... 132/200; 132/285

[58] Field of Search ..... 132/200, 73, 73.5, 132/285, 319

[56] References Cited

U.S. PATENT DOCUMENTS

| | | | |
|---|---|---|---|
| 388,519 | 8/1888 | Ahlquist | 132/73 |
| 478,356 | 7/1892 | Paige | 132/73 |
| 1,231,270 | 6/1917 | Knudsen | 132/73.5 |
| 1,917,794 | 7/1933 | Brown | 132/73 |
| 2,031,225 | 2/1936 | O'Donnell | 132/73 |
| 2,566,852 | 9/1951 | Platt | 132/73 |
| 3,245,418 | 4/1966 | Dinerstein | 132/285 |
| 3,382,878 | 5/1968 | Dinerstein | 132/285 |
| 4,605,024 | 8/1986 | Tremblay | 132/88.5 |
| 5,577,521 | 11/1996 | Neutlich | 132/285 |

FOREIGN PATENT DOCUMENTS

| | | | |
|---|---|---|---|
| 1347157 | 11/1963 | France | 132/73 |

*Primary Examiner*—Todd E. Manahan
*Attorney, Agent, or Firm*—Skinner, Sutton & Watson; Charles Hartman

[57] ABSTRACT

Acrylic and fiberglass fingernails are applied using an aid having a flexible fingernail support shield wrappable around the end of a human finger defining an aperture suitable to receive a fingernail. A substantially conical resilient pinching member defining an expandable slit is placed over the flexible support shield and the fingernail augmentation is applied over the shield.

13 Claims, 2 Drawing Sheets

FIG. 1
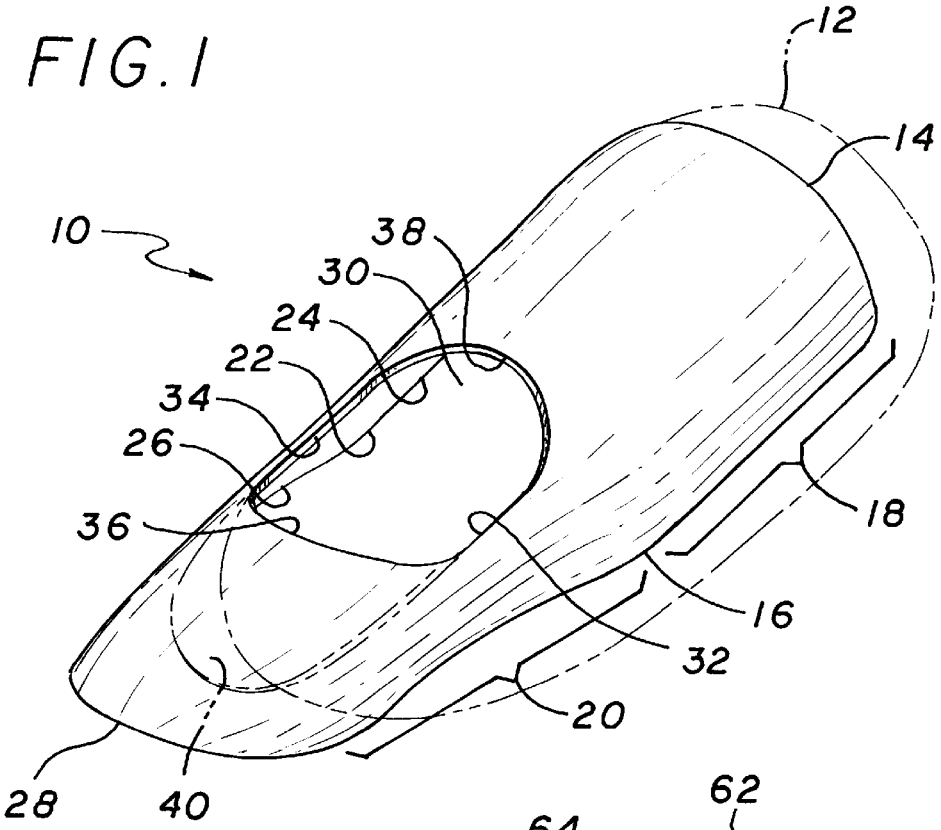
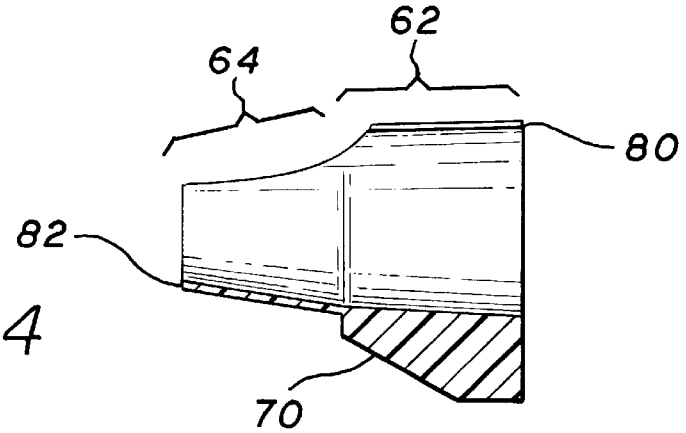
FIG. 4
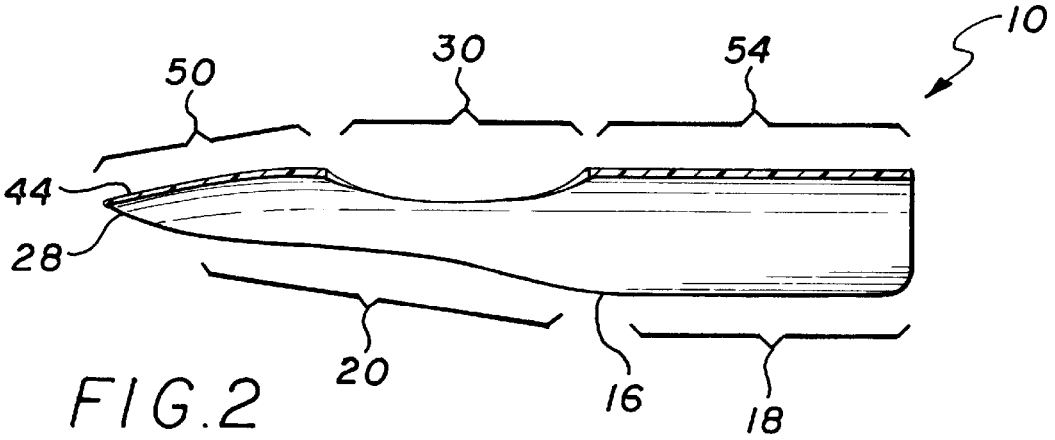
FIG. 2

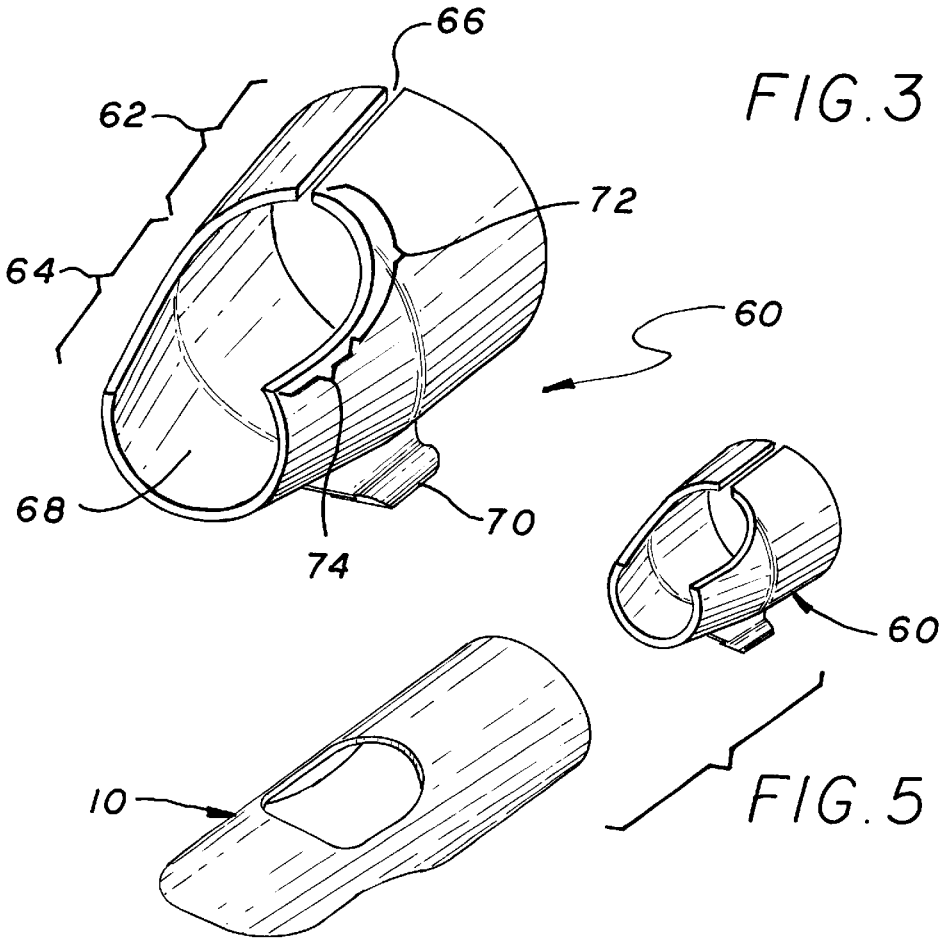
FIG. 3
FIG. 5
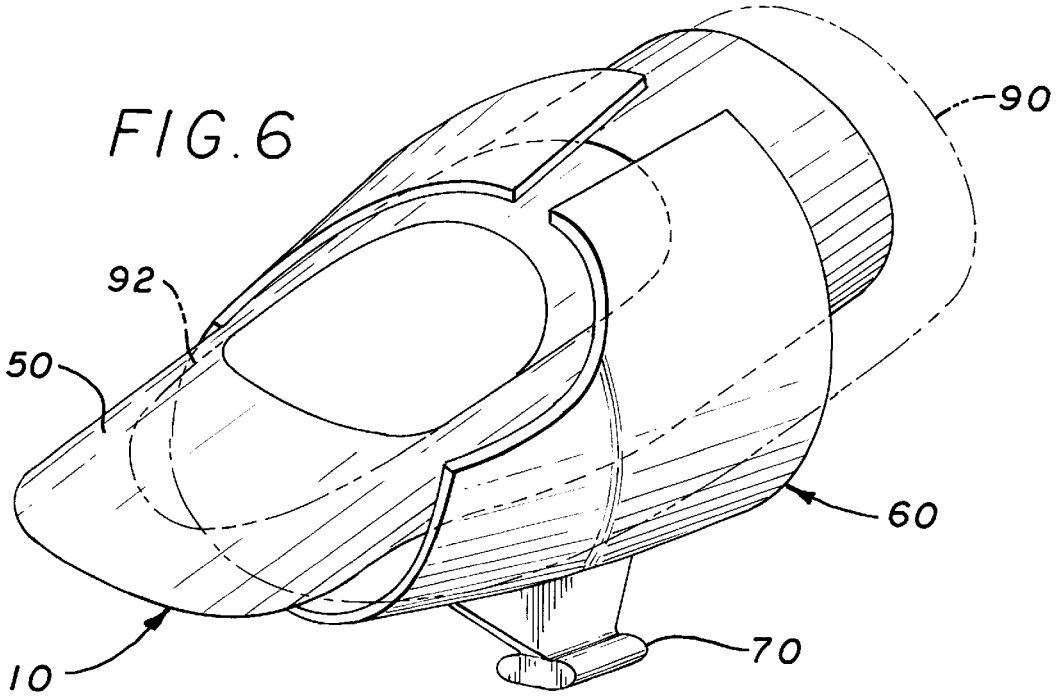
FIG. 6

ARTIFICIAL FINGERNAIL ATTACHMENT AID AND METHOD

BACKGROUND OF THE INVENTION

1. Field of the Invention

This invention relates to apparatus and methods of fingernail augmentation, particularly to apparatus and methods of placing acrylic or fiberglass fingernail augmentation.

2. State of the Art

People sometimes desire longer fingernails than they naturally have, usually for fashion reasons. Short fingernails can be the result of the demands of work—long fingernails can interfere with some types of work, or the nature of the work may tend to keep them undesirably trimmed at an unfashionably short length—fragile fingernails, or the habit of biting fingernails. A variety of augmentation methods are available including, preformed plastic fingernail forms that are gluable to the tops of the existing fingernails, and more elaborate acrylic and fiberglass fingernail augmentation. Of course, after augmentation, fingernails can be painted to achieve the attractive look desired.

Another feature of fingers and fingernails is that they come in a variety of shapes and sizes. Any augmentation method has to be readily adaptable to this variation, not only among people, but on the hands of the same person.

One great problem with the fingernail augmentation is that the artificial fingernails look artificial. Plastic glued on fingernails tend to look too thin and sometimes have odd shapes, and acrylic fingernails look natural on top, but flat and odd below. This is because most of the artificial fingernail augmentation methods now available for acrylic fingernails are essentially pieces of some flexible material that is arched over the finger, creating the effect of a cylinder longitudinally cut in half. Use of this as a base results in the flat bottom effect.

One attempt to overcome these difficulties is the approach taken in U.S. Pat. No. 4,605,024 to Tremblay. There he teaches the use of an apparatus and method to protect the fingernail and cuticle from the harsh chemicals and abrasive tools used to affix artificial fingernails. However, the form used therein is a cumbersome form having complex hinged parts.

What the art needs is a form that is simple, easy to use, and allows acrylic or fiberglass artificial fingernails to be applied while creating a natural looking artificial fingernail, on both the top of the fingernail and on the bottom.

SUMMARY OF THE INVENTION

This invention provides a means to apply acrylic and fiberglass fingernail augmentation. An aid having a flexible fingernail support shield wrappable around the end of a human finger defining an aperture suitable to receive a fingernail is placed on the end of a fingernail. It is secured in place by a substantially conical resilient pinching member defining an expandable slit placed over the flexible support shield. The fingernail augmentation applied over the shield then assumes the shape of a natural fingernail.

One aspect of this invention is an artificial fingernail application aid having two components. The first is a flexible fingernail support shield wrappable around the end of a human finger. The flexible fingernail support shield includes a rear edge, a first side edge having a first finger engaging portion and a first fingernail support edge at an angle to the finger engaging portion, and a second side edge having a second finger engaging portion substantially parallel to the first finger engaging portion and a second fingernail support edge disposed at an acute angle relative to the first fingernail support edge, and a generally arcuate tip edge intersecting the first fingernail support edge and the second fingernail support edge. The flexible fingernail support shield defines a fingernail receiving aperture, the aperture defined by a first aperture side edge, a second aperture side edge, a fingernail bed engagement edge and a back edge. The second is a substantially conical resilient pinching member having a body defining an expandable slit. The slit expands to a cut away portion positionable over the fingernail worked on.

Another aspect of this invention is a method of applying artificial fingernails. A flexible fingernail support shield having an aperture through which the tip of a finger can extend is wrapped around the end of a finger. The flexible member is secured by placing a substantially conical resilient pinching member defining an expandable slit over the flexible support shield. The slit expands to a cut away portion positionable over the fingernail worked on such that the fingernail is positioned at the cut away portion of the conical resilient pinching member. The fingernail augmentation is then applied. The substantially conical resilient pinching member is removed by pulling from the side of the finger opposite the fingernail. The flexible fingernail support shield is removed by rotating it relative to the junction between the finger and the fingernail and sliding it over the newly augmented fingernail.

Yet another aspect of this invention is an artificial fingernail application aid comprising:

a flexible fingernail support shield wrappable around the end of a human finger defining an aperture suitable to receive a fingernail; and a substantially conical resilient pinching member defining an expandable slit, the slit expanding to a cut away portion positionable over the fingernail worked on receivable on the end of a finger, for securing the flexible fingernail support member.

BRIEF DESCRIPTION OF THE DRAWINGS

FIG. 1 shows a perspective view of the flexible fingernail support shield of one embodiment of this invention.

FIG. 2 shows a cutaway plan view of the flexible fingernail support shield shown in FIG. 1.

FIG. 3 shows a perspective view of the substantially conical resilient pinching member of one embodiment of this invention.

FIG. 4 shows a cut away plan view of the substantially conical resilient pinching member shown in FIG. 3.

FIG. 5 shows a perspective view of the flexible fingernail support shield and in position to be received by the substantially conical resilient pinching member.

FIG. 6 shows an embodiment of this invention showing the flexible fingernail support shield and received by the substantially conical resilient pinching member on a finger undergoing augmentation.

DETAILED DESCRIPTION OF THE PREFERRED EMBODIMENT

Referring now to FIG. 1, a flexible fingernail support shield 10 wraps around the end of a human finger 12 (shown in phantom). The flexible fingernail support shield includes a rear edge 14, a first side edge 16 having a first finger engaging portion 18 and a first fingernail support edge 20 disposed at an angle to the finger engaging portion, and a second side edge 22 having a second finger engaging portion 24 substantially parallel to the first finger engaging portion 18 and a second fingernail support edge 26 disposed at an acute angle relative to the first fingernail support edge 20, and a generally arcuate tip edge 28 intersecting the first fingernail support edge 20 and the second fingernail support edge 26. The flexible fingernail support shield 10 defines a fingernail receiving aperture 30. The aperture 30 has a first aperture side edge 32, a second aperture side edge 34, a fingernail bed engagement edge 36 and a back edge 38.

The human finger 12 has a fingernail 40 disposed on top of a support section of the flexible fingernail support shield 10. As shown in the FIG., the shield has not yet been wrapped around and secured to the finger. The fingernail bed engagement edge 36 is snugly abutted to the junction of the fingernail 40 and the fleshy part of the finger. It is preferable that the fingernail bed engagement edge 36 be pre-cut in the shape of an ellipse to conform to the junction of the fingernail and the finger.

Referring to FIG. 2, the molded flexible support 10, has two curves molded into it. A first curve, 44, the 'natural curve', allows the fingernail to achieve the curve desirable in the finished fingernail, both on the top of the fingernail and on the bottom of the fingernail. The second curve, the 'C curve', not shown in FIG. 2, but implied by the down-turned first side edge 16 of the flexible support, allows the flexible support to curve around the finger. The first side edge 16 has a first finger engaging portion 18 and a first fingernail support edge 20 disposed at an angle to the finger engaging portion. In FIG. 2, due to the complex twin curvature, the first fingernail support edge 20 and the arcuate tip edge 28 it intersects appears as an 'S' curve, but in reality the first fingernail support edge 20 is preferred to be a straight edge. The top of the flexible support is divided into three portions, the fingernail support portion 50, the aperture 30, and the finger engaging portion 54. It will also be seen that the thickness of the flexible shield decreases from the thickest portion in the finger engaging portion of the shield 54, to a minimum in the fingernail support portion 50.

In use, the fingernail extends through the aperture 30 and rests on the fingernail support portion 50. The finger engaging portion extends over the rest of the finger, past the first joint, the joint where the fingernail grows, and frequently covering the entire second joint of the finger as well, although that coverage depends on how large the particular finger is.

Referring to FIG. 3, the flexible shield is secured to the finger by a pinching clip 60. The pinching clip generally has a substantially conical shape. In the preferred embodiment, the conical shape has two cones of different slope superimposed on each other, a first cone 62 near the larger end of the clip and a second cone 64, more sharply sloped cone near the apex of the cone. In the embodiment shown in FIG. 3 the first cone is also where the resilient pinching member has an expandable slit 66. The slit expands to a cut away portion 68 positionable over the fingernail worked on. At the bottom of the clip is a release member 70 extending away from the body portion, disposed around the conical body at least 90 degrees from the slit and preferably disposed 180 degrees from the location of the slit. In use the clip is removed from the fingers by grasping the release and pulling. The resilient material slides over the finger, leaving the fingernail untouched and the setting acrylic or fiberglass undisturbed.

The cut-away portion 60 of the conical clip has two shapes, a cut away arch 72 and a straight cut 74, substantially parallel to the axis of the cone. The straight cuts allow the member to bear down especially hard on the tip of the finger. This shapes the flexible member into a natural fingernail form that closely follows the curve of the fingernail being augmented.

Referring to FIG. 4 the conical member has two different cones of different slopes. The finger is surrounded by the conical member, and the slit (not shown in this drawing) allows the clip to expand to snugly fit the finger. The top portion 80 of the clip is not as thick as the bottom portion 82 to allow the clip to slide easily off the finger without disturbing the setting acrylic or fiberglass.

The material chosen for the flexible fingernail shield and the conical clip must be unreactive with the solvents used for the application of artificial fingernails. One such preferred material is polypropylene.

Referring now to FIG. 5, the flexible support shield is positioned to receive the conical clip. It will be noticed that in the unsecured position shown, the flexible shield is larger than the interior diameter of the conical clip. The flexible shield is deformed by the conical clip to snugly hold the finger.

Referring now to FIG. 6 a finger 90 (shown in phantom) has been placed in the device of the present invention. The fingernail is positioned on the fingernail support portion of the flexible shield as shown in FIG. 1, but the clip member is positioned over the flexible member pinching the portion of it near the tip 60 of the finger tightly to create a natural looking fingernail. In this FIG. the release can be seen and how the fingernail is left undisturbed by the removal of the clip member. The flexible shield is removed by rotating the flexible fingernail support shield relative to the junction between the finger and the fingernail and sliding it over the newly augmented fingernail so that the newly augmented fingernail and the setting acrylic or fiberglass passes through the aperture undisturbed.

In use acrylic and fiberglass fingernails are applied to the fingernails, on top of the aid wrapped around the end of a human finger. The flexible fingernail support shield is substantially as shown in FIG. 1. The fingernail passes through the aperture of the shield and the fingernail bed engagement edge of the aperture engages the junction between the fingernail and the fleshy part of the fingertip. The flexible fingernail support shield is secured to the finger with a substantially conical resilient pinching member or clip substantially as described with reference to FIG. 3. The clip's expandable slit passes over the flexible support shield, pinching it and forming it snugly into a natural fingernail shape against the fingertip. The cut away portion is positioned over the fingernail so that the fingernail augmentation, for example, acrylic or fiberglass fingernail material, or any other fingernail augmentation material that requires application to the fingernail, can be brushed onto the fingernail and the fingernail support portion 50. Using this method the flexible support shield forms a natural "C" curve and the natural arch of the fingernail.

The form is removed by pulling the substantially conical resilient member from the side of the finger opposite the fingernail. It is flexible enough that it comes off without touching the newly augmented fingernail. The flexible support shield is removed by rotating the flexible fingernail support shield relative to the junction between the finger and the fingernail and sliding it over the newly augmented fingernail. The aperture is large enough to allow the flexible shield to pass over the newly augmented fingernail without touching it and disturbing the fingernail augmentation material. Removal of the flexible shield allows both sides of the fingernail to air dry, therefore allowing application of the polish or other fingernail enhancement more quickly.

This invention has been described by reference to a specific embodiment. Other embodiments will undoubtedly suggest themselves to those having skill in the art. Therefore, Applicants intend the appended claims to encompass all such newly suggested embodiments.

We claim:

1. An artificial fingernail application aid comprising:

a flexible fingernail support shield wrappable around the end of a human finger, the flexible fingernail support shield including a rear edge, a first side edge having a first finger engaging portion and a first fingernail support edge at an angle to the finger engaging portion, and a second side edge having a second finger engaging portion substantially parallel to the first finger engaging portion and a second fingernail support edge disposed at an acute angle relative to the first fingernail support edge, and a generally arcuate tip edge intersecting the first fingernail support edge and the second fingernail support edge, the flexible fingernail support shield defining an fingernail receiving aperture, the aperture defined by a first aperture side edge, a second aperture side edge, a fingernail bed engagement edge and a back edge; and a substantially conical resilient pinching member having a body defining an expandable slit, the slit expanding to a cut away portion positionable over the fingernail worked on.

2. The application aid of claim 1 wherein the flexible support shield forms a "C" curve.

3. The application aid of claim 1 wherein the flexible support shield forms a natural curve when secured to the fingernail.

4. The application aid of claim 1 wherein the substantially conical resilient pinching member has a first portion, having a first thickness of material and a second portion, substantially defined by the cut away portion having a second thickness of material.

5. The application aid of claim 4 wherein the second thickness tapers from the first thickness at the junction of the first portion to a thinner thickness.

6. The application aid of claim 1 wherein the substantially conical resilient pinching member further includes a release member extending away from the body portion, disposed around the conical body at least 90 degrees from the slit.

7. The application aid of claim 6 wherein the substantially conical resilient pinching member further includes a release member extending away from the body portion, disposed around the conical body at substantially 180 degrees from the slit.

8. A method of applying artificial fingernails comprising:

placing a flexible fingernail support shield wrappable around the end of a human finger, the flexible fingernail support shield including a rear edge, a first side edge having a first finger engaging portion and a first fingernail support edge at an angle to the finger engaging portion, and a second side edge having a second finger engaging portion substantially parallel to the first finger engaging portion and a second fingernail support edge disposed at an acute angle relative to the first fingernail support edge, and a generally arcuate tip edge intersecting the first fingernail support edge and the second fingernail support edge, the flexible fingernail support shield defining an fingernail receiving aperture, the aperture defined by a first aperture side edge, a second aperture side edge, a fingernail bed engagement edge and a back edge around a finger tip such that the aperture receives the fingernail, the fingernail bed engagement edge engaging the junction between the fingernail and the finger, and at least some portion of the fingernail extending over the support shield; and securing the flexible fingernail support shield with a substantially conical resilient pinching member defining an expandable slit over the flexible support shield, the slit expanding to a cut away portion positionable over the fingernail worked on such that the fingernail is positioned at the cut away portion of the conical resilient pinching member; and applying fingernail augmentation.

9. The method of claim 8 wherein the flexible support shield forms a "C" curve.

10. The method of claim 8 wherein the flexible support shield forms a natural curve when secured to the fingernail.

11. The method of claim 8 wherein the fingernail augmentation is selected from the group consisting of fiberglass and acrylic fingernail augmentation.

12. The method of claim 8 wherein the step of removing the substantially conical resilient member comprises pulling the substantially conical resilient member from the side of the finger opposite the fingernail.

13. The method of claim 8 wherein the step of removing the flexible fingernail support shield comprises rotating the flexible fingernail support shield relative to the junction between the finger and the fingernail and sliding it over the newly augmented fingernail.

* * * * *